United States Patent [19]

Prades

[11] Patent Number: 4,527,705

[45] Date of Patent: Jul. 9, 1985

[54] BOTTLE STOPPER

[75] Inventor: José F. Prades, Torello, Spain

[73] Assignee: Vem De Tapas Metalicas, S.A., Barcelona, Spain

[21] Appl. No.: 579,575

[22] Filed: Feb. 13, 1984

[30] Foreign Application Priority Data

Jul. 29, 1983 [ES] Spain ..... 273813

[51] Int. Cl.[3] ..... B65D 41/34

[52] U.S. Cl. ..... 215/252; 215/341

[58] Field of Search ..... 215/341, 343, 345, 348, 215/350, 252

[56] References Cited

U.S. PATENT DOCUMENTS

| | | | |
|---|---|---|---|
| 2,068,389 | 1/1937 | Smith | 215/350 |
| 3,944,103 | 3/1976 | Cros | 215/350 X |
| 4,244,481 | 1/1981 | Kornelis | 215/348 |
| 4,346,811 | 8/1982 | Hilaire | 215/252 |

FOREIGN PATENT DOCUMENTS

| | | | |
|---|---|---|---|
| 47374 | 6/1971 | Australia | 215/341 |
| 1327583 | 8/1973 | United Kingdom | 215/341 |

*Primary Examiner*—Donald F. Norton
*Attorney, Agent, or Firm*—Joan H. Pauly

[57] ABSTRACT

A bottle stopper having a cap shaped body of substantially rigid plastics material and a seal applied to the body bottom edge region and the side wall region adjacent said bottom, the bottom being provided with a concentric inwardly extending rib and a plurality of recesses between the rib and the said wall, while the side wall is internally provided with an annular flange close to the bottom and a plurality of hollows between the flange and the bottom. The seal is disposed between said rib and said flange and fills said recesses and hollows.

8 Claims, 6 Drawing Figures

Fig. 1
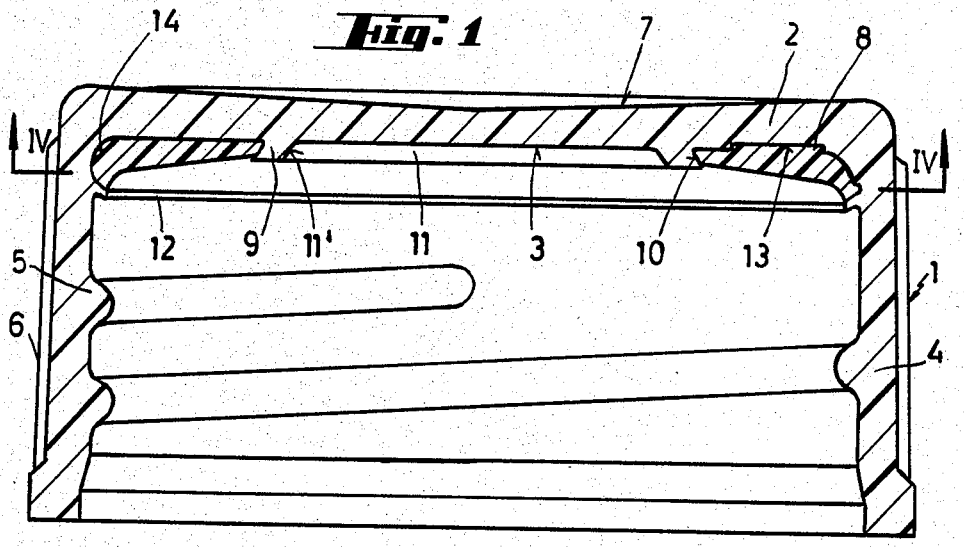
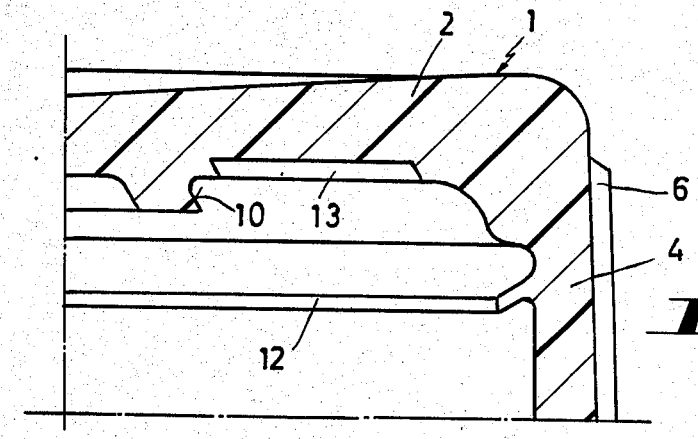
Fig. 2
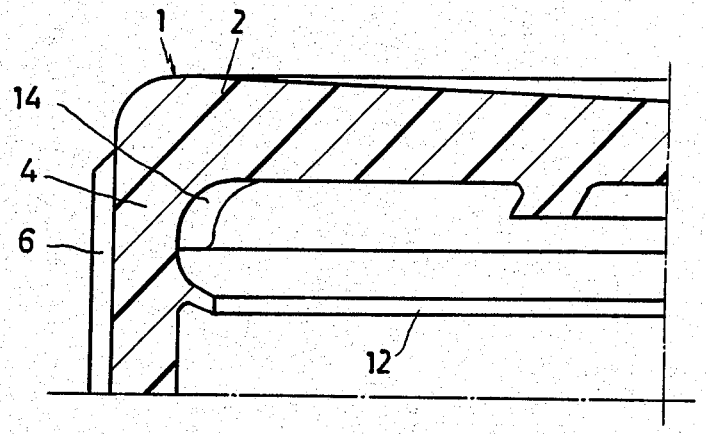
Fig. 3

Fig. 5
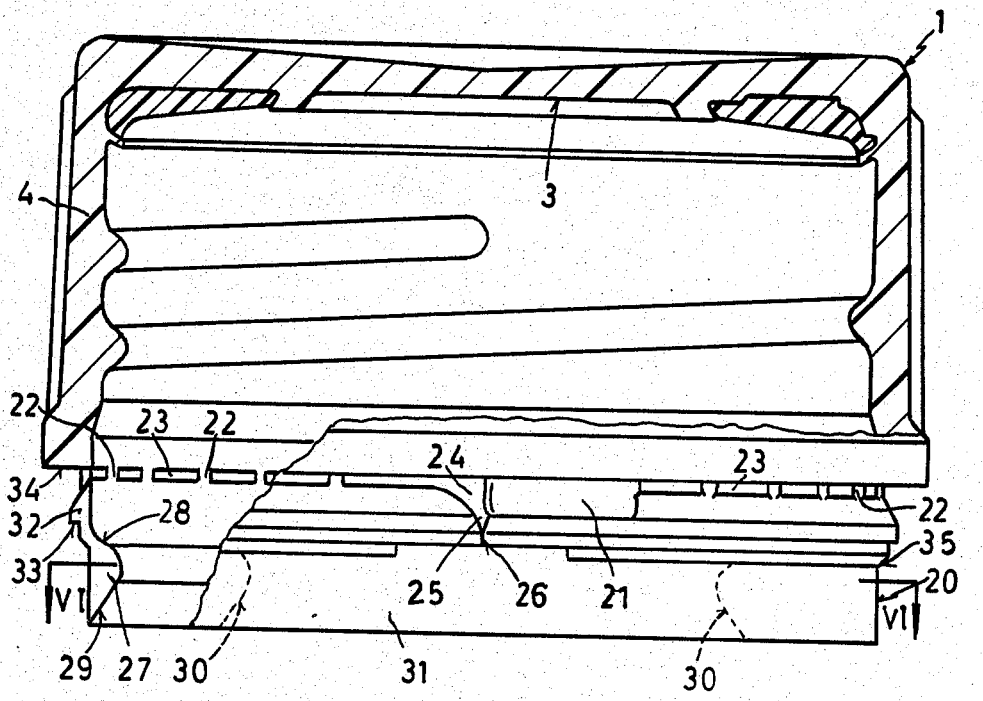
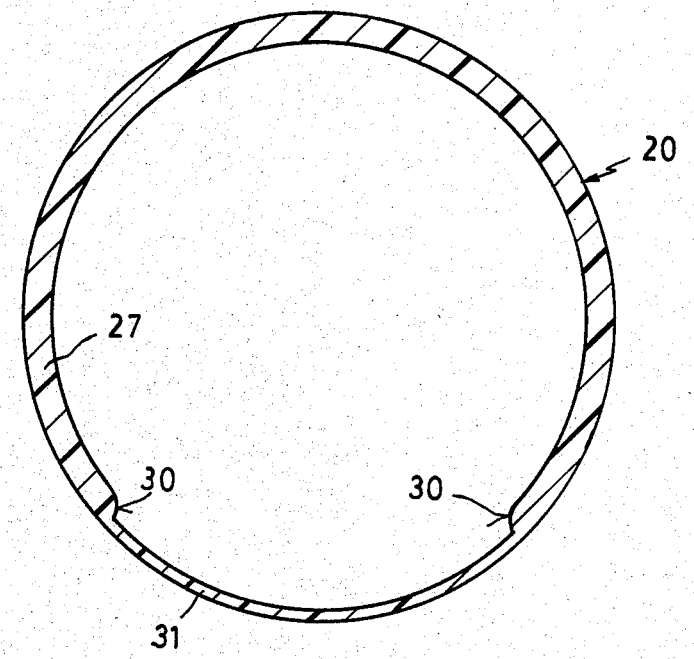
Fig. 6

BOTTLE STOPPER

FIELD OF THE INVENTION

The present invention relates to a bottle stopper of the type comprising a substantially rigid plastics body and a seal, said body being shaped as a cap having an internally threaded side wall and said seal being applied to the body bottom edge region and to the side wall region adjacent said bottom.

STATE OF THE ART

Stoppers of the above described type are generally used for closing vessels containing products which have been packaged under vacuum or contain pressurised carbonated drinks. In either case the known stoppers usually suffer from the drawback of adhering firmly to the vessel by their seal when closed. Consequently, when the vessel is opened by unscrewing the stopper, there is frequently a relative rotation between the stopper body portion and the seal, thereby deforming the seal, making it hard to open the vessel and also the seal becomes practically useless for resealing the vessel.

With a view to providing a better bond between the stopper body portion and the seal it is known in metal stoppers to use a material such as a polyvinyl chloride plastisol as seal. This plastisol is applied in paste form to the bottom of the metal stopper and then the stopper and seal are heat-treated, for example in hot air, to gel the said material, whereby it becomes a resilient solid bonding satisfactorily to the metal body. Nevertheless, this is obviously not applicable to plastics stoppers, since the body would be adversely affected by the heat. It should be recalled that in the known metal stoppers, the bottom is smooth, which is unfavourable for the bond between the stopper body and the seal.

SUMMARY OF THE INVENTION

The object of the invention is to overcome the above mentioned drawbacks. Thus, according to the invention, a stopper of the type described above is characterised in that the bottom of the body is provided with a concentric rib and also has a plurality of recesses between the rib and the side wall, while the side wall is provided on the inside thereof with an annular flange close to the bottom and between the flange and the bottom there is a plurality of hollows, said seal being formed between said rib and said flange and filling said recesses and said hollows.

The sealing material in the recesses and hollows acts as an anchor for the whole seal and prevents the relative rotation of the seal and the stopper body, thereby overcoming problems in unscrewing the stopper due to the seal possibly sticking to the vessel.

According to a further feature of the invention, the seal comprises a resilient solid material resulting from the gelling of a pasty material under the action of microwave radiation carried out after application of the pasty material to the stopper body.

The recesses and hollows may be filled with seal material preferably by spraying the material in past form, with possible centrifugation, for subsequent gelling. Since the gelling is caused by microwave radiation, the plastics material of the stopper body is not affected and thus a polyvinyl chloride plastisol may be used as sealing material for a plastics stopper.

It is further known that certain plastics bottle stoppers have a security member integrally attached to the side wall of the stopper cap as an axial extension thereof, such that the transition from said side wall to the security member comprises weakened members. On the inside the security member is provided with an inwardly extending peak adapted to engage an outwardly extending retaining rib of the vessel.

When a stopper that has been installed on the vessel is unscrewed for the first time, the mutual action of the said peak and rib prevent the security member from following the axial movement of the cap, thereby breaking the weakened members and revealing any prior attempt to open the vessel.

In many cases, the security member completely separates from the cap and, therefore, remains around the vessel. The residual security member has the drawback of requiring its removal in case of recovery of the vessel. A stopper of this type is disclosed in Spanish utility model No. 236,293 and Spanish patent of invention No. 470,243, both filed May 26, 1978, and the corresponding British Pat. No. 2,022,063, published Dec. 12, 1979.

In other cases, the shape of the security member prevents it from being completely separated from the cap (by way of a reinforced portion in the transition from the side wall to the security member), there being provided in such cases an axial weakening of the security member across which the latter breaks to allow the vessel to be opened. Nevertheless, difficulties frequently arise in the known types for breaking axially the security member and additional means have to be used.

These drawbacks are overcome according to the invention because the security member is provided with an opening having a pointed portion adjacent said reinforced portion, with the apex pointing away from the cap, said opening being immediately adjacent said said wall and because said security member has a thin portion centred relative to said pointed portion and from which said inwardly extending transverse peak is missing, providing a priority line of rupture as a prolongation of said apex.

BRIEF DESCRIPTION OF THE DRAWING

The invention is described in fuller detail hereinafter, with reference to the accompanying drawings, in which:

FIG. 1 is an axial cross section view of the stopper along the line I—I of FIG. 4;

FIG. 2 is a part axial cross sectional view in a larger scale of the stopper, showing a recess;

FIG. 3 is a sectional view similar to the above but showing a side hollow;

FIG. 5 is a side view of the stopper, partly in axial section, showing the stopper with a security member; and FIG. 6 is a sectional view of the stopper security member along the line VI—VI of FIG. 5, on a smaller scale.

DETAILED DESCRIPTION

Figure 4:
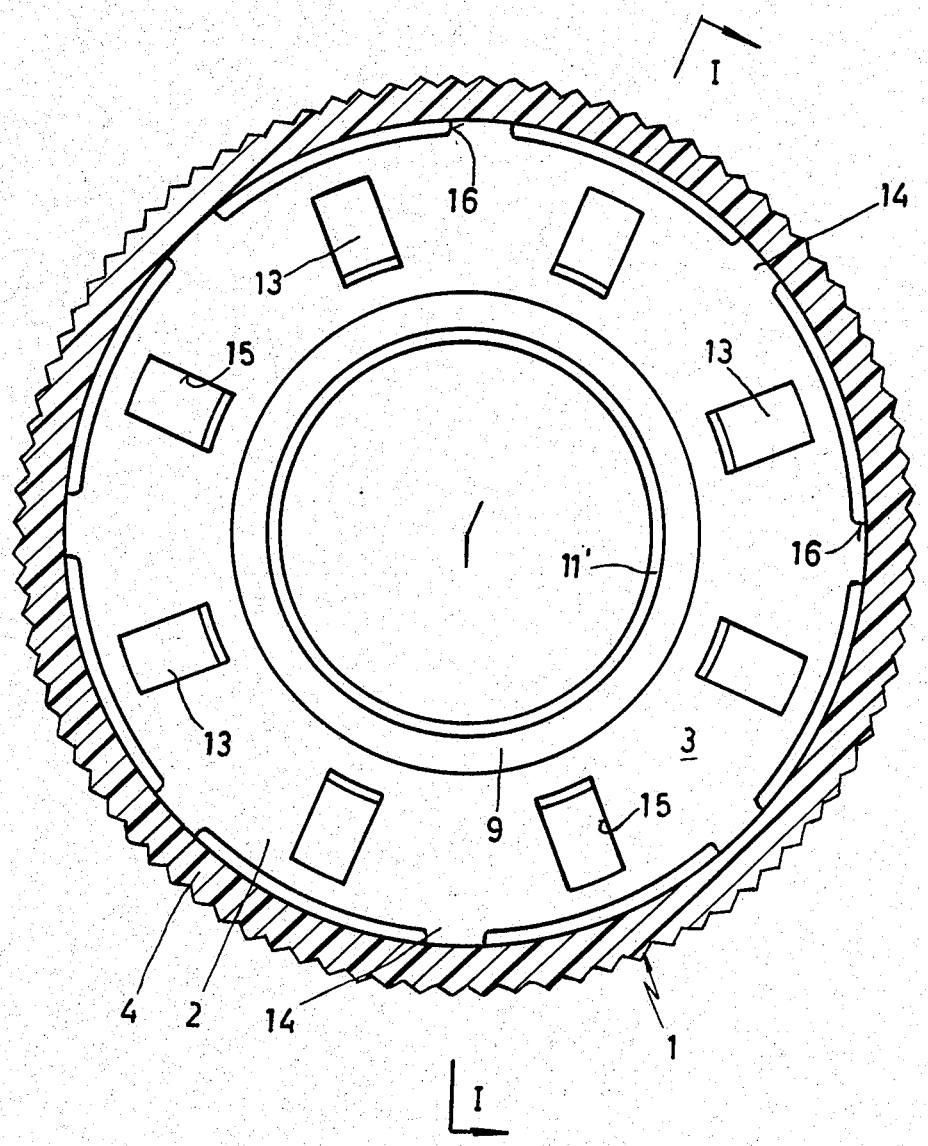
FIG. 4 is a cross sectional view along the line IV—IV of FIG. 1, but not showing the seal.

The stopper comprises a body 1 of substantially rigid plastics material, shaped essentially as a cap and having a base portion 2, the inner surface of which provides the bottom 3 of the stopper and a side wall 4.

The said side wall 4 is internally provided with a conventional screw thread 5 for adaptation of the stopper to the corresponding container, for closing the latter. The thread may be a single or a multiple thread. Furthermore, the body 1 of the stopper may be provided with other features which do not form part of the invention and which are therefore only listed without being described in detail, namely, the knurling 6 to allow the stopper to be grasped more reliably and the recessed portion 7 in the outer surface of the bottom 3 of the stopper body 1.

The stopper also comprises a seal 8 applied to the body 1 at least in the edge or peripheral area of the bottom 3 of the stopper and also to the inner area of the side wall 4 adjacent said bottom 3. This seal 8 is for abutting the top edge of the container neck or mouth and to the upper side wall of said mouth or neck when the vessel is closed. The resilient properties of the seal make it hermetic, thereby isolating the interior of the vessel.

The body 1 of the stopper of the invention is provided with an annular concentric rib extending from the bottom 3 of the stopper. The outer side surface 10 of the rib is preferably tapered progressively outwards from the axis of the stopper from the bottom 3 and is provided also with a central cavity 11, bordered by a surface 11' which is also preferably sloping like surface 10.

The side wall 4 is also provided with an inwardly extending annular flange 12 close to the bottom 3 of the body.

In the bottom 3 of the stopper body between the annular rib 9 and the side wall 4, there is a plurality of preferably radially extending recesses 13 at regular intervals. Furthermore, on the inside of the side wall 4 between the annular flange 12 and the bottom 3 there is a plurality of hollows 14, preferably of the same number as the radial recesses 13, also at regular intervals and preferably alternating with the recesses.

So that said recesses and hollows may fulfill the anchoring function to be described hereinafter, it is desirable for them to have substantially radially extending surfaces 15 and 16.

The seal 8 is disposed between the rib 9 and the annular flange 12. This seal 8 comprises a resilient solid material, preferably resulting from the gelling of a pasty consistency material, said gelling being caused by the action of microwave radiation. This material, for example, may be a polyvinyl chloride plastisol. The material is applied in paste form to the stopper body by known techniques of metered spraying and the stopper is thereafter preferably vigorously rotated to centrifuge the pasty material, thereby providing for the correct distribution thereof in the space comprised between the flange 12 and rib 9.

The stopper is then subjected to microwave radiation to gel the pasty material, without the plastics material forming the stopper body being affected thereby.

Nevertheless, the seal 8 may be applied to the stopper body by other conventional techniques. In such cases, the seals are formed e.g. by a hot-melt, polyurethane foam applied in pasty state, or a silicone also applied in pasty state. In all cases, these pasty seals become solid resilient seals in a few minutes.

The seal 8 is required always to fill the recesses 13 and hollows 14. Consequently, when the stopper is unscrewed from the vessel, the portions of the seal in the recesses and hollows act as an anchor and therefore prevent the seal from remaining adhered to the vessel when the body 1 is unscrewed. In other words, the relative rotation of the seal 8 and body 1 is avoided, particularly by the opposition to said rotation offered by the radially extending surfaces 15 and 16.

It is also contemplated that, at least in part, the internal surfaces of the body that are to be in contact with the seal should be roughened, thereby promoting the said opposition to rotation.

FIGS. 5 and 6 illustrate a stopper differing from the heretofore described one only in that it is provided with the security member 20.

The security member 20 is axially connected to the side wall 4 of the cap shaped body 1. The transition between the security member 20 and the side wall 4 is formed by a plurality of weakened means and by a reinforced portion 21. The weakened means comprise, in the embodiment illustrated, a plurality of bridges alternating with perforations 23. The bridges and perforations extend almost all the way around the circular region of the security member adjacent the side wall 4, interrupted only by the reinforced portion 21 and by an aperture 24 adjacent the said portion 21.

The aperture 24 is provided with a pointed portion 25 terminating in an apex 26 directed away from the cap. Except for the pointed portion 25, the aperture 24 is aligned with the perforations 23.

The security member 20 is provided also with an inwardly extending transverse peak 27. Said peak 27 engages an outwardly extending retaining rib on the vessel by way of the top surface 28 of the former. When the vessel is closed for the first time with the stopper, the security member 20 opens as the lower surface 29 (gently sloping) slides over the vessel's retaining rib until the said peak 27 passes beyond the said retaining rib.

Said transverse peak 27 does not extend all around the interior of the security member 20, but is provided with end portions 30 terminating relatively close to the apex 26. Between said end portions 30 there is a thin portion 31 of the security member, substantially centered about the said apex 26 and said thin portion 31 has an extension corresponding to an arc of from 40 to 90 degrees. The coincidence of the pointed portion 25 with the thin portion 31 determines an ideal priority rupture line as a continuation of the apex 26.

When the vessel is opened for the first time, the stopper on being unscrewed is axially displaced away from the vessel. The security member 20, retained by its peak 27 against the retaining rib of the vessel, cannot follow such axial movement which, in the first place, causes the rupture of the bridges 22. Nevertheless, the reinforced portion 21 is sufficiently strong not to rupture during this stage, but since the urge to continue the axial movement persists, the security member fractures axially along the above mentioned priority line of rupture. Thus the vessel is opened without the security member 20 remaining retained thereon.

The security member 20 is also provided with a peak 32, the surface 33 of which removed from the cap shaped body 1 is generally parallel to the bottom 3 of the body. Furthermore, as is conventional, the edge 34 of the side wall 4 is provided also with at least one portion generally parallel to said bottom.

The co-existence of the surface 33 and the edge 34 provide the unique advantage of allowing the stopper with security member to be injection moulded without the need for having mould members transversally moveable relative to the mould axis. The provision of the inwardly extending annular peak 27 on the security member does cause mould stripping problems and since this security member has two support surfaces 33 and 34 for ejecting the stopper from the inner mould, stresses which may cause failure of the weakened bridges during mould stripping are avoided.

The portion of the security member limited by the chamfered surface 35 and joining the upper and lower portions of the security member is missing from the region of the pointed portion 25. In turn, the pointed portion of the aperture 24 is located on the peak 32, whereby this peak 32 does not affect the conditions of the abovementioned ideal priority rupture line.

What I claim is:

1. A bottle stopper of the type having a substantially rigid plastics body and a seal, said body having a cap form with an internally threaded side wall and said seal being applied to the area of the edge of the body bottom and the side wall area adjacent said bottom, wherein the body bottom is provided with a concentric rib and between said rib and the side wall a plurality of recesses while the side wall is provided on the inner side thereof with an annular flange close to the bottom and between said flange and the bottom a plurality of hollows, said seal being comprised between said rib and said flange and filling said recesses and hollows, said side wall being integrally axially attached to a security member, the transition between said side wall to said security member being constituted by weakened means and by a reinforced portion, said security member having on the inside thereof an inwardly extending transverse peak adapted to engage an outwardly extending rib of the vessel, wherein said security member is provided with an aperture having a pointed portion adjacent said reinforced portion having the apex thereof extending away from the cap portion, said aperture being adjacent said side wall and wherein said security member has a thin portion centered relative to said pointed portion from which said inwardly extending transverse peak is missing, forming an ideal line of priority rupture beyond said apex.

2. The bottle stopper of claim 1, wherein said seal is constituted by a resilient solid material resulting from the gelling of a pasty consistency material under microwave radiation, effected after application of said pasty material to the stopper body.

3. The bottle stopper of claim 2, wherein the stopper surfaces on which the seal is applied are at least partly roughened.

4. The bottle stopper of claim 1, wherein said recesses extend radially and said recesses and said hollows are disposed at regular intervals.

5. The bottle stopper of claim 4, wherein said recesses and said hollows are interspaced.

6. The bottle stopper of claim 5, wherein the stopper surfaces on which the seal is applied are at least partly roughened.

7. The bottle stopper of claim 3, wherein the stopper surfaces on which the seal is applied are at least partly roughened.

8. The bottle stopper of claim 1, wherein the stopper surfaces on which the seal is applied are at least partly roughened.

* * * * *